US009162933B1

(12) United States Patent
Hordos et al.

(10) Patent No.: US 9,162,933 B1
(45) Date of Patent: Oct. 20, 2015

(54) AUTO-IGNITION COMPOSITION

(75) Inventors: Deborah L. Hordos, Troy, MI (US); Sean P. Burns, Almont, MI (US); Graylon K. Williams, Warren, MI (US); Larry A. Moquin, Riley, MI (US); Paresh S. Khandhadia, Troy, MI (US)

(73) Assignee: TK Holding Inc., Armada, MI (US)

( * ) Notice: Subject to any disclaimer, the term of this patent is extended or adjusted under 35 U.S.C. 154(b) by 560 days.

(21) Appl. No.: 12/658,279

(22) Filed: Feb. 5, 2010

Related U.S. Application Data

(63) Continuation-in-part of application No. 11/789,756, filed on Apr. 24, 2007.

(60) Provisional application No. 61/206,982, filed on Feb. 5, 2009.

(51) Int. Cl.
*C06B 29/00* (2006.01)
*C06B 45/04* (2006.01)

(52) U.S. Cl.
CPC ..... *C06B 29/00* (2013.01); *C06B 45/04* (2013.01)

(58) Field of Classification Search
CPC ..... C06B 29/00; C06B 45/04
USPC ..... 149/36
See application file for complete search history.

(56) References Cited

U.S. PATENT DOCUMENTS 3,558,285 A 1/1971 Ciccone et al. ..... 23/281
3,711,115 A 1/1973 Lohr ..... 280/150
3,787,010 A 1/1974 Meranshian et al. ..... 244/146
3,862,866 A 1/1975 Timmerman et al. ..... 149/21
3,902,934 A 9/1975 Timmerman ..... 149/83
3,923,884 A 12/1975 Yonemitsu et al. ..... 260/536
4,337,352 A 6/1982 Naumann ..... 562/401
5,221,765 A 6/1993 Patil et al. ..... 562/401
5,380,380 A 1/1995 Poole et al. ..... 149/22
5,538,568 A 7/1996 Taylor et al. ..... 149/70
5,567,905 A * 10/1996 Barnes et al. ..... 102/289
5,670,740 A * 9/1997 Barnes et al. ..... 149/62
5,763,821 A 6/1998 Wheatley ..... 149/19.5
5,854,442 A 12/1998 Scheffee et al. ..... 149/18
6,464,254 B2 10/2002 Chikaraishi et al. ..... 280/741
6,517,647 B1 2/2003 Yamato ..... 149/45
6,527,297 B1 3/2003 Parkinson et al. ..... 280/741
6,588,797 B1 7/2003 Blomquist ..... 280/741
6,673,172 B2 * 1/2004 Wheatley et al. ..... 149/36
6,682,616 B1 1/2004 Yamato et al. ..... 149/45
6,752,421 B2 6/2004 Khandhadia et al. ..... 280/741
6,779,812 B2 8/2004 Ishida et al. ..... 280/741

(Continued)

OTHER PUBLICATIONS

U.S. Appl. No. 11/789,756.

(Continued)

*Primary Examiner* — Aileen B Felton
(74) *Attorney, Agent, or Firm* — L.C. Begin & Associates, PLLC

(57) ABSTRACT

An auto ignition composition is provided that contains a sugar and/or carboxylic acid such as DL-tartaric acid as a first fuel; a binder; and an alkali or alkaline earth metal chlorate such as potassium chlorate as a first oxidizer. Alkali metal perchlorates such as potassium perchlorate may also be included as a second oxidizer. The composition(s) is typically contained within a gas generating system such as an airbag inflator or seat belt assembly, or more broadly within a vehicle occupant protection system. The compositions may also be applied to the insides of military armament.

8 Claims, 2 Drawing Sheets

(56) References Cited

U.S. PATENT DOCUMENTS

| | | | | |
|---|---|---|---|---|
| 6,800,154 | B1 | 10/2004 | Carey et al. | 149/2 |
| 6,918,976 | B2 | 7/2005 | Sato et al. | 149/19.1 |
| 7,073,820 | B2 | 7/2006 | McCormick | 280/741 |
| 2003/0024618 | A1 | 2/2003 | Wu et al. | 149/19.7 |
| 2004/0084885 | A1* | 5/2004 | Burns et al. | 280/741 |
| 2004/0232679 | A1 | 11/2004 | Kubo et al. | 280/741 |
| 2005/0161135 | A1* | 7/2005 | Williams et al. | 149/45 |
| 2006/0220362 | A1 | 10/2006 | Hordos | |
| 2007/0246138 | A1 | 10/2007 | Hordos | 149/74 |
| 2008/0149232 | A1 | 6/2008 | Newell | |

OTHER PUBLICATIONS

U.S. Appl. No. 12/592,690.
U.S. Appl. No. 12/658,279.
Office Action U.S. Appl. No. 11/497,149, filed Jul. 31, 2006; Dated Aug. 25, 2009 (121).
Office Action U.S. Appl. No. 11/497,149, filed Jul. 31, 2006; Dated Apr. 8, 2010 (121).
Office Action U.S. Appl. No. 11/906,348, filed Oct. 1, 2007; Dated Dec. 24, 2009 (164).
Office Action U.S. Appl. No. 11/906,348, filed Oct. 1, 2007; Dated Mar. 29, 2010 (164).
Office Action U.S. Appl. No. 11/789,756, filed Apr. 24, 2007, Mailed Jun. 27, 2011 (155).
Office Action U.S. Appl. No. 11/789,756, filed Apr. 24, 2007, Mailed Dec. 16, 2010 (155).
Office Action U.S. Appl. No. 11/497,149, filed Jul. 31, 2006, Mailed Sep. 5, 2012 (121).
Office Action U.S. Appl. No. 11/497,149, filed Jul. 31, 2006, Mailed Aug. 25, 2009 (121).
Office Action U.S. Appl. No. 11/497,149, filed Jul. 31, 2006, Mailed Apr. 8, 2010 (121).
Office Action U.S. Appl. No. 11/497,149, flied Jul. 31, 2006, Mailed Nov. 23, 2010 (121).

* cited by examiner

AUTO-IGNITION COMPOSITION

CROSS REFERENCE TO RELATED APPLICATIONS

This application claims the benefit of U.S. Provisional Application Ser. No. 61/206,982 filed on Feb. 5, 2009. This application is also a continuation-in-part of co-owned U.S. application Ser. No. 11/789,756 herein incorporated by reference in its entirety and having a filing date of Apr. 24, 2007, and claims priority thereto.

BACKGROUND OF THE INVENTION

Explosive devices including gas generators, military ordnance or artillery shells, and other munitions pose a mass detonation hazard in the event of a fire onboard a sea-going vessel or in a storage facility such as a warehouse or a magazine. It is an ongoing challenge to actuate these devices prior to the temperature exceeding the point of detonation or explosion.

Auto-ignition materials in automotive air bag inflators or on military ordnance, for example, allow the respective device to safely deploy or actuate in the event of a fire. By including an auto-ignition composition the likelihood of a safety hazard resulting from the bursting of an inflator is substantially reduced.

Accordingly, most inflators or gas generators for vehicle occupant protection systems, for example, typically include an auto-ignition composition juxtaposed next to a discrete booster composition. In the event of a fire, the auto-ignition composition ignites to thereby ignite the booster composition which thereby ignites the main gas generant. As such, the fire hazard is substantially mitigated.

Yet another challenge is to apply the auto-ignition composition on or within the respective device to permit quick ignition of the composition and subsequent actuation of the primary propellant or gas generating composition within the respective device.

Yet another challenge is to ensure the thermal stability and integrity of the composition when aged in severe environments for long periods of time.

Yet another challenge is to provide a composition that will self-ignite over a wide range of temperatures by tailoring the constituents therein.

SUMMARY

A pyrotechnic formulation comprising an auto-ignition composition (e.g. a fuel and an oxidizer such as d-glucose and potassium chlorate) and a binder that self-ignites at a specific design temperature or temperature range. The pyrotechnic also serves to provide auto-ignition functionality in military contexts.

Furthermore, the auto-ignition composition also propagates ignition of the main gas generation through flame and/or heat propagation. The sequence of events for the auto-ignition of an inflator includes the ignition of the auto-ignition material, which subsequently ignites an associated booster material, which in turn ignites the main gas generating pyrotechnic. This invention facilitates safe deployment of an associated device even in the midst of a fire event, thereby preventing mass detonation and safety concerns associated therewith.

In accordance with the present invention, the auto-ignition composition may be extruded upon any surface juxtaposed to a primary gas generant bed, thereby providing thermodynamic communication between the auto-ignition composition, and a booster composition and main propellant of a typical gas generator. Accordingly, the design provides greater conduction of heat to the primary gas generant of the inflator thereby enhancing auto-ignition function in case of a fire.

In yet another aspect of the invention, the present compositions may be applied to military devices due to their compatability with Insensitive Munitions (IM) requirements. Accordingly, the present compositions may be coated within the inside of a military shell thereby providing auto-ignition and safe activation in the event of a fire of all ordnance containing the composition.

DETAILED DESCRIPTION OF THE PREFERRED EMBODIMENT

Figure 1:
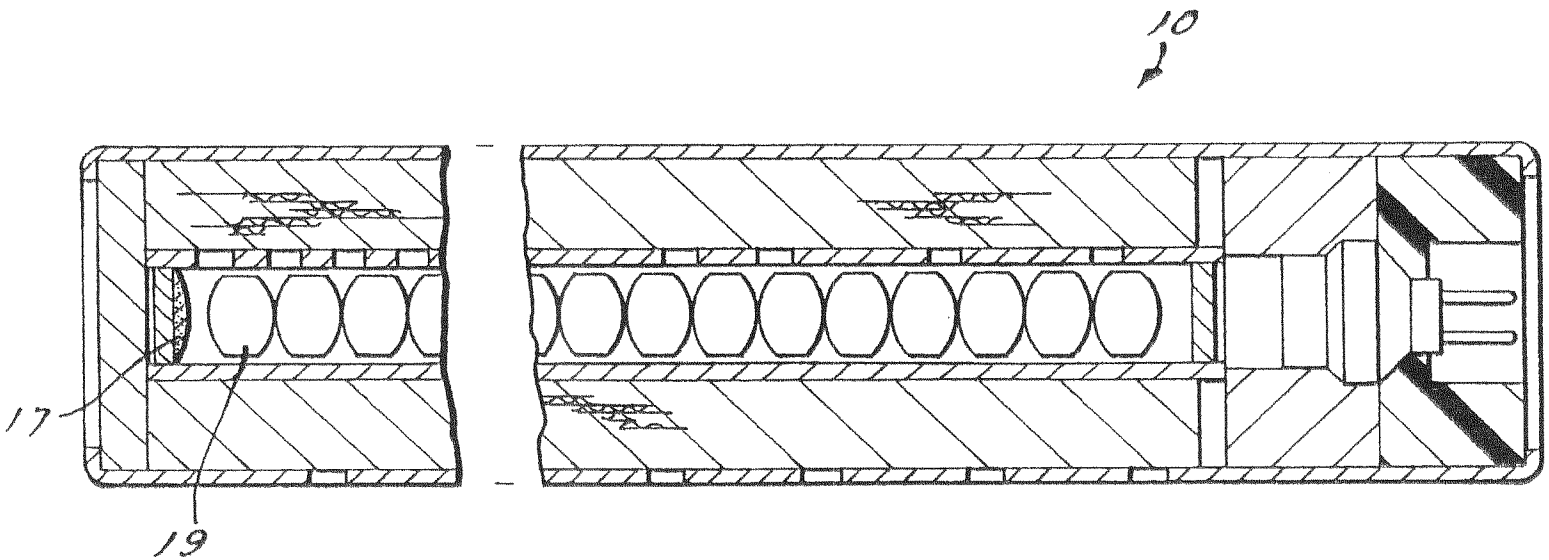
FIG. 1 is a cross-sectional view of an inflator assembly in accordance with the present invention.

The present invention includes an auto-ignition component and a secondary component combined to form a substantially uniform mixture or composition. The auto-ignition component may be any known auto-ignition component such as the combination of d-glucose and potassium chlorate, or nitrocellulose. A secondary component may be formed from silicone or other rubbers at about 10-50 weight percent of the total composition when combined with the auto-ignition component, and a secondary oxidizer such as potassium perchlorate. Other constituents of the secondary component may be formed from known gas generant compositions so long as silicone or another suitable binder is also included therein. In addition to silicone, other binders include chlorinated rubber, polyvinylchloride (PVC), cellulose acetate butyrate (CAB), and mixtures thereof.

A preferred auto-ignition component of the present invention includes a primary fuel and a primary oxidizer, that self-ignites at a specific temperature, particularly at a temperature less than or equal to 250° C. A primary fuel is preferably selected from at least one from the group of sugars such as d-glucose, maltose, fructose, and sucrose, and organic acids such as tartaric acid at about 15-45 weight percent of the auto-ignition composition. Exemplary organic acids include the various enantiomers of tartaric acid including DL-tartaric acid, L-tartaric acid, D-tartaric acid, meso-tartaric acid, and mixtures thereof. Other exemplary organic acids include malic acid, succinic acid, diglycolic acid, malonic acid, trans-glutaconic acid, adipic acid, mucic acid, 2,2-Bis(hydroxymethyl) propionic acid, citric acid, phenylmalonic acid, and quinic acid. Exemplary enantiomers of this group include D-tartaric acid, DL-tartaric acid, Meso-tartaric acid, D-glutamic acid, and D-quinic acid. The organic acid should preferably have a melting point ranging from about 125 to about 250° C. and pass a heat aging test at 107° C. for 400 hours. The auto-ignition temperature of the fuel is preferably about 250 to 110° C. as determined by differential scanning calorimetry/thermogravimetric analysis (DSC/TGA).

An auto-ignition component oxidizer contains a metal chlorate salt at about 55-85 weight percent of the auto-ignition composition, preferably potassium chlorate. The metal chlorate salt may be selected from the group including alkali, alkaline earth, and transitional metal chlorates, and mixtures thereof.

In accordance with the present invention, the auto-ignition oxidizer and the auto-ignition fuel are preferably dry-mixed or otherwise combined into a substantially homogeneous auto-ignition composition, pelletized, and then crushed and granulated to form substantially homogeneous granules of the auto-ignition composition for mixture in the present compositions.

The compositions of the present invention include any auto-ignition composition known in the art and silicone, or another suitable binder at about 10-35 weight percent of the total composition. The oxidizer included in the auto-ignition composition, such as potassium chlorate, when provided in sufficient oxidizing quantities, may also function to oxidize the silicone or binder as well as the auto-ignition fuel, thereby providing a booster function within an inflator, for example. A preferred auto-ignition/booster composition includes a granulated auto-ignition composition, a fuel/binder formed from silicone at 10-35% by weight of the total composition, and a booster oxidizer (preferably potassium perchlorate) at about 35-55 weight percent of the total composition.

The term "silicone" as used herein will be understood in its generic sense. Hawley describes silicone (organosiloxane) as any of a large group of siloxane polymers based on a structure consisting of alternate silicon and oxygen atoms with various organic radicals attached to the silicon:

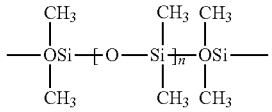

Formula 1: Silicone Example

Or, silicone can be more generically represented as shown in Formula 2 (but not thereby limited):

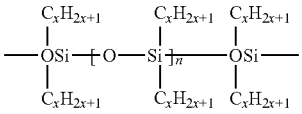

Formula 2: Silicone Example

Note, "n" in the Formulas indicates a multiple of the polymeric group or portion of the molecule given within the brackets, to include the organic groups attached to the silicon. Certain benefits realized by the use of silicone in the present compositions include: the booster function within an auto-ignition composition; the formation of a compressible elastic structure when the silicone is cured thereby facilitating ease of positioning and retention within the inflator assembly and ensuring intimate thermal contact with the outer surface of the inflator; an extrudable thixotropic composition when the silicone is uncured thereby facilitating ease of insertion within the inflator assembly; and ease of ignition of the primary gas generant from the auto-ignition input, and from a relatively hot combustion temperature from combustion of the silicone/oxidizer composition.

Exemplary silicones as binders include those disclosed in U.S. Pat. Nos. 5,589,662, 5,610,444, and 5,700,532, and, in TECHNOLOGY OF POLYMER COMPOUNDS AND ENERGETIC MATERIALS, Fraunhofer-Institut fur Chemische Technologie (ICT), 1990, each reference and document herein incorporated by reference. Silicone may be provided by any known supplier such as Shin-Etsu Silicones of America, Inc. of Akron, Ohio. It will be appreciated that curing and addition of the silicone or binder matrix (further described below) is done in accordance with manufacturer instructions.

In general, the binder or binder matrix is selected from one or more of the following: addition curing silicones, and/or other binders such as chlorinated/halogenated rubbers such as Parlon®, Viton®, Teflon®, Kraton®, and polyvinylchloride; high-melting waxes such as Epolene®; and ceramic binders such as Ceramabind®. In general, binder matrices that are water-soluble, or condensation curing adhesives, or binders that generate a by-product during the curing reactions are not preferred.

A preferred auto-ignition composition contains by weight percent of the composition silicone at about 25 wt %, a primary fuel such as DL-tartaric acid and a primary oxidizer such as potassium chlorate that when combined are provided at about 35 wt %, and potassium perchlorate as a secondary oxidizer at about 40 wt %, said percents taken by weight of the total composition. As known in the art, the various constituents of the present compositions may be granulated in relatively smaller particle sizes by a ball mill, vibrator mill, fluid energy mill, or hammer mill.

A secondary component of the present invention therefore may contain a secondary fuel and if desired, a secondary oxidizer. A secondary oxidizer is selected from metal perchlorates, metal nitrates, metal nitrites, metal oxides, basic metal nitrates, and mixtures thereof. A preferred secondary oxidizer is selected from alkaline earth and alkali metal perchlorates, for example, including potassium perchlorate.

It should be appreciated that the auto-ignition oxidizer, potassium chlorate for example, may be provided in quantities and granular sizes sufficient to oxidize both the auto-ignition and secondary fuel components. In general, many known gas generant compositions, for use within vehicle occupant protection systems for example, may be employed in addition to silicone and any secondary oxidizer, as secondary components of the present compositions. Known gas generant compositions as described in U.S. Pat. Nos. 5,035,757, 6,210,505, 6,287,400, 6,074,502, 5,872,329, 5,756,929, and 5,531,941, all incorporated by reference, exemplify gas generants and/or boosters that function to raise the pressure of an associated pressure vessel, thereby propagating combustion of a primary gas generant bed.

A secondary fuel may be selected from the group of fuels including nitrogen-containing fuels, guanidines, aminoguanidines, tetrazoles, triazoles, metal and nonmetal salts of tetrazoles and triazoles, and mixtures thereof. The secondary oxidizer may therefore when desired be selected from metal and nonmetal salts of chlorates, perchlorates, nitrates, nitrites, permanganates, oxides, and mixtures thereof. The metal salts may be selected from alkali, alkaline earth, and transitional metal salts, and mixtures thereof. The secondary fuel is provided at about 0-25 weight percent of the secondary component. The secondary oxidizer represents 0-75 weight percent of the secondary component. A preferred oxidizer is potassium perchlorate. It has been observed that the use of silicone with any auto-ignition composition may provide the same benefit, that is auto-ignition and booster functionality, while still providing the manufacturing advantages described below.

The auto-ignition composition or component including the fuel and oxidizer is provided at about 20-60 weight percent of the total composition whereas the secondary composition or component containing all required and optional constituents is provided at about 40-80 weight percent. When formulating the auto-ignition compositions of the present invention, each constituent is first granulated when provided as a solid. As such, the auto-ignition component may be formed by mixing granulated potassium chlorate with a granulated sugar and/or granulated organic acid. A planetary mixer may be employed to provide uniform or substantially homogeneous mixtures of the various granules. It will be appreciated that tailoring of the burn rates or ballistic properties may be accomplished through iteratively determining the desired average granular size for each constituent. When employing secondary components, any other constituents known for their utility in auto-ignition/gas generant compositions may also be incorporated into the auto-ignition component in granulated form. As such, ballistic modifiers, coolants, and other useful additives could also be provided in known effective amounts or in known effective weight percents.

The secondary component may be formulated in the same way and therefore a pelletized gas generant containing a fuel and an oxidizer may be granulated and then mixed as described above. Again, other constituents known for their utility in auto-ignition/gas generant compositions such as ballistic modifiers and coolants may also be provided in known effective amounts or in known effective weight percents. The gas generant constituents of the present invention may be supplied by well known suppliers such as Aldrich Chemical Company of Milwaukee, Wis.

Once the auto-ignition component is formulated, the auto-ignition and secondary components may be mixed together to result in substantially uniform or homogeneous extrudable thixotropic mixtures. The uncured mixture may then be applied to any desired surface within an associated gas generator within a vehicle occupant protection system, for example, thereby simplifying gas generator manufacture. Once cured, the mixture forms an elastic compressible solid.

Accordingly, uncured compositions of the present invention may be applied to the inside of the housing of an airbag inflator or ordnance shell, for example. In particular, the uncured composition may be coated about the payload of the armament or shell, thereby ensuring the safe management and actuation of the armament in the event of a fire. If desired, the compositions may subsequently be cured in accordance with the cure properties of the binder selected.

Compositions made in accordance with the present invention are exemplified in the following Examples.

EXAMPLE 1

An auto-ignition component is formed from about 35 wt % L-tartaric acid as a first fuel and 45 wt % of potassium chlorate as a first oxidizer, said percents taken by weight of the total composition. Silicone is provided at about 20 wt % of the total composition. The dry first fuel and dry first oxidizer, in granular form, are added to silicone and mixed to a homogeneous composition. The composition is then cured to provide an auto-ignition/booster composition.

A hot plate and DSC test were conducted. The hot plate test was done by heating the sample in a metal crucible at about 20 degrees C. per minute. The hot plate auto-ignition temperature was found to be 155 C. The Differential Scanning calorimetry (DSC) Test was conducted by increasing the heat applied to the sample at about 5 degrees C. per minute. The DSC auto-ignition onset temperature was found to be 143 C.

EXAMPLE 2

An auto-ignition component is formed from about 41 wt % DL-tartaric acid as a first fuel and 10 wt % of potassium chlorate as a first oxidizer, said percents taken by weight of the total composition. Next, 45 wt % of potassium perchlorate as a booster oxidizer, and 4 wt % of cellulose acetate butyrate (CAB) are provided, said percents taken by weight of the total composition. The first fuel, first oxidizer, and booster oxidizer are provided in dry granular form, and are then added to CAB and mixed to a homogeneous composition. The composition is then cured to provide an auto-ignition/booster composition.

A hot plate and DSC test were conducted. The hot plate test was done by heating the sample in a metal crucible at about 20 degrees C. per minute. The hot plate auto-ignition temperature was found to be 174 C. The Differential Scanning calorimetry (DSC) Test was conducted by increasing the heat applied to the sample at about 5 degrees C. per minute. The DSC auto-ignition onset temperature was found to be 179 C.

EXAMPLE 3

An auto-ignition component is formed from about 19.16 wt % DL-tartaric acid as a first fuel, 12.5 wt % succinic acid as a second fuel, and 16.67 wt % of potassium chlorate as a first oxidizer, said percents taken by weight of the total composition. Next, 35 wt % of potassium perchlorate as a booster oxidizer, and 16.67 wt % of chlorinated rubber as a binder are provided, said percents taken by weight of the total composition. The first and second fuels, first oxidizer, and booster oxidizer are provided in dry granular form, and are then added to uncured chlorinated rubber, and mixed to a homogeneous composition. The composition is then cured to provide an auto-ignition/booster composition.

A hot plate and DSC test were conducted. The hot plate test was done by heating the sample in a metal crucible at about 20 degrees C. per minute. The hot plate auto-ignition temperature was found to be 167 C. The Differential Scanning calorimetry (DSC) Test was conducted by increasing the heat applied to the sample at about 5 degrees C. per minute. The DSC auto-ignition onset temperature was found to be 180 C.

EXAMPLE 4

An auto-ignition component is formed from about 11.5 wt % DL-tartaric acid as a first fuel, 7.5 wt % succinic acid as a second fuel, and 10 wt % of potassium chlorate as a first oxidizer, said percents taken by weight of the total composition. Next, 21 wt % of potassium perchlorate as a booster oxidizer, and 50 wt % of chlorinated rubber as a binder are provided, said percents taken by weight of the total composition. The first and second fuels, first oxidizer, and booster oxidizer are provided in dry granular form, and are then added to uncured chlorinated rubber, and mixed to a homogeneous composition. The composition is then cured to provide an auto-ignition/booster composition.

A hot plate and DSC test were conducted. The hot plate test was done by heating the sample in a metal crucible at about 20 degrees C. per minute. The hot plate auto-ignition temperature was found to be 161 C. The Differential Scanning calorimetry (DSC) Test was conducted by increasing the heat applied to the sample at about 5 degrees C. per minute. The DSC auto-ignition onset temperature was found to be 172 C.

EXAMPLE 5

An auto-ignition component is formed from about 25.83 wt % succinic acid as a first fuel, and 16.67 wt % of potassium chlorate as a first oxidizer, said percents taken by weight of the total composition. Next, 40.83 wt % of potassium perchlorate as a booster oxidizer, and 16.67 wt % of polyvinylchloride as a binder are provided, said percents taken by weight of the total composition. The first fuel, first oxidizer, and booster oxidizer are provided in dry granular form, and are then added to uncured polyvinylchloride, and mixed to a homogeneous composition. The composition is then cured to provide an auto-ignition/booster composition.

A hot plate and DSC test were conducted. The hot plate test was done by heating the sample in a metal crucible at about 20 degrees C. per minute. The hot plate auto-ignition temperature was found to be 189 C. The Differential Scanning calorimetry (DSC) Test was conducted by increasing the heat applied to the sample at about 5 degrees C. per minute. The DSC auto-ignition onset temperature was found to be 206 C.

EXAMPLE 6

In accordance with the present invention, a composition containing potassium perchlorate at about 42%, potassium chlorate at about 20%, d,l-tartaric acid at about 23%, and succinic acid at about 15%, said percents stated by weight of the composition without the binder added, is provided and prepared by forming a homogeneous composition. The oxygen balance (to carbon dioxide) was determined to be 0.75%. When combusted, the gas yield was found to be 65.3% of the total effluent. The BOE impact sensitivity was determined to be 7.0 inches. The BAM friction sensitivity was determined to be 168 N.

EXAMPLE 7

A composition formed as provided in Example 6 was prepared. Several slugs were prepared by pressing the composition into several types of hex bushings to include six bushings, wherein among the six bushings, a single bushing is provided made from Uftem™ (tradename), black propylene, brass, 304SS, iron, and aluminum, respectively. The slugs were then heat aged for 26 days at 75 C. A blank bushing was heat aged within the group as a control. Corrosion or interaction between the composition and each slug after heat aging was evaluated. All samples aged well with minimal weight loss. As shown in Example 8, no significant change in DSC measurements were found after heat aging.

After heat aging, the aluminum plug was determined to have a 0.04% mass loss. The 304 stainless steel (SS) plug and the respective composition were determined to have a 0.01% mass loss, while the control plug had no mass loss. The brass plug and the respective composition were determined to have a 0.01% mass loss, while the control plug had no mass loss. The black propylene plug was determined to have a 0.22% loss, while the respective composition was found to have a 0.08 loss, and the control plug was found to have a 0.14% loss. The malleable iron and the respective composition were determined to have a 0.01% mass loss, while the control plug had no mass loss. The Ultem plug was determined to have a 0.015% mass loss, the respective composition was determined to have a 0.003% mass loss, and the control plug was determined to have a 0.12% mass loss. The reactive plugs were corrosion free after heat aging and had minimal weight loss. Further, the composition was therefore found to be compatible with the various plastic and metal materials evaluated.

EXAMPLE 8

The respective composition of each bushing/plug was evaluated by differential scanning calorimetry after heat aging as described in Example 7. The DSC auto-ignition temperatures were found to be 162 C for a baseline sample, 163 C for the composition taken from the aluminum plug, 164 C for the composition taken from the brass reactive plug, 164 C for the composition taken from the 304SS plug, 160 C for the composition taken from the malleable iron plug, 165 C for the composition taken from the polypropylene plug, and, 165 C for the composition taken from the Ultem plug. The DSC evaluations of the composition after heat aging showed no more than a 3 degree C. change in DSC peak. This analysis meets the requirement of Mil-Std-1751A.

EXAMPLE 9

A composition formed as provided in Example 6 was prepared. The composition was heat aged at 107 C for 600 hours. Thereafter, the composition was evaluated by differential scanning calorimetry (DSC). No change in the DSC auto-ignition temperature was found after heat aging.

EXAMPLE 10

A composition formed as provided in Example 6 was prepared. The composition was heat aged at 107 C for 25 days, with a 1:1 weight ratio per component evaluated. The composition alone and baseline was determined to have a 161 C DSC auto-ignition temperature. The composition with low alloys steel was determined to have a 161 C auto-ignition temperature. The composition with aluminum was determined to have a 165 C auto-ignition temperature. The composition with acrylic adhesive was determined to have a 167 C auto-ignition temperature. The composition with glass-filled nylon was determined to have a 169 C auto-ignition temperature. The composition with EPDM gaskets was determined to have a 166 C auto-ignition temperature. No corrosion was observed for any of the materials.

EXAMPLE 11

A composition formed as provided in Example 6 was prepared. The DOT classification was 1.3 C and 1.4 C. The composition passed the Cap Test with 50 lbs in 4G drum and 1 kg packaging. Other comparative compounds including BKNO3, RDX, and HMX all failed the Cap Test and required special packaging.

EXAMPLE 12

A composition formed as provided in Example 6 was prepared. (1) The BOE Impact $H_{50}$ (inches) was 7.0, the BAM friction (N) was 168, and the ESD (J) was greater than 0.25. (2) BKNO3 was also evaluated. The BOE Impact $H_{50}$ (inches) was 3.4, the BAM friction (N) was 353, and the ESD (J) was greater than 0.25. (3) RDX was also evaluated. The BOE Impact $H_{50}$ (inches) was 3.7, the BAM friction (N) was 115, and the ESD (J) was greater than 0.25. (4) HMX was also evaluated. The BOE Impact $H_{50}$ (inches) was 3.1, the BAM friction (N) was 108, and the ESD (J) was greater than 0.25.

Typical inflator assembly methods require the formation of an auto-ignition repository within the inflator structure. Auto-ignition tablets may then be placed within the repository and sealed or enclosed within the repository with a taped seal. A booster composition may then be placed proximate to the auto-ignition composition thereby facilitating thermodynamic communication between the two compositions upon auto-ignition of the auto-ignition composition.

In contrast, a pellet of cured booster/auto-ignition material may be positioned in the inflator assembly such that it is wedged or compressed into place whereby a first surface of the material is in intimate contact with an exterior component or housing of the inflator. Accordingly, the inflator assembly can be designed such that no additional features or components are required to keep the booster/auto-ignition material in position.

It will also be appreciated that an uncured extrudable auto-ignition/booster mixture may be applied directly to a desired surface that interfaces with the primary gas generant and thermodynamically communicates with the outside of the inflator. The mixture may then be cured thereafter in accordance with manufacturer instructions. As such, the surface area of the auto-ignition composition in contact with the desired surface may be increased and/or optimized to provide a more effective interface to increase and/or tailor thermodynamic communication with the primary gas generant chamber. When compared to typical inflator assembly, the present auto-ignition/booster compositions provide an improved method of assembly thereby resulting in ease of assembly and reduced manufacturing costs, and also resulting in improved performance predictability.

Accordingly, in yet another aspect of the invention, an inflator manufacturing method and a gas generating system is provided wherein the gas generating system includes an inflator formed from a manufacturing method including the following steps:

1. combining a granulated auto-ignition composition with uncured silicone or binder matrix to form an auto-ignition composition wherein the silicone or binder matrix is provided at about 10-50 wt % of the total composition;
2. providing an inflator or armament device having a surface for receipt of the auto-ignition/booster composition wherein the surface provides thermodynamic communication between the auto-ignition composition and the exterior of the device, and a primary gas generant composition within the inflator; and
3. extruding the auto-ignition composition containing the uncured binder matrix onto the surface.

All other aspects of inflator manufacture or military armament may be accommodated as known in the art. This is exemplified in the inflator references discussed below and incorporated herein by reference. Accordingly, in the gas generator context, components such as the inflator housing, igniter, filter, gas generant compositions, and other typical inflator components may all be manufactured, formed, supplied, and assembled in manners known in the art. The noteworthy benefit in the present manufacturing method is the ability to extrude auto-ignition/booster compositions in one step by virtue of the use of uncured silicone therein.

In contrast, in many known manufacturing methods, placement of a discrete auto-ignition composition and placement of a discrete booster composition within the inflator consists of at least two separate steps, and each composition must be contained within a respective repository or cavity. The compositions of the present invention, when extruded in an uncured state, may then be later cured as per silicone manufacturer directions. Roughening the surface to receive the auto-ignition/booster composition, prior to extrusion of the auto-ignition/booster composition thereon, may simplify and/or facilitate deposition of the auto-ignition/booster composition on the desired surface. The surface may be any surface that is conveniently located within the inflator, on a surface that may exist for other structural reasons, for example. Accordingly, an exemplary surface might exist upon a chamber divider within the inflator, or, it might exist upon an igniter support tube within the inflator. Other typical inflator surfaces might also accommodate placement of the auto-ignition/booster composition extrusion so long as the surface provides thermodynamic communication between the auto-ignition/booster composition and a primary gas generant composition.

Compositions formulated in accordance with the present invention preferably auto-ignite at about 250 degrees Celsius or less, and inhibit the production of noxious gases. Unlike certain known auto-ignition compositions, many compositions of the present invention also survive standard heat aging testing at 107 degrees Celsius for 400 hours.

Figure 2:
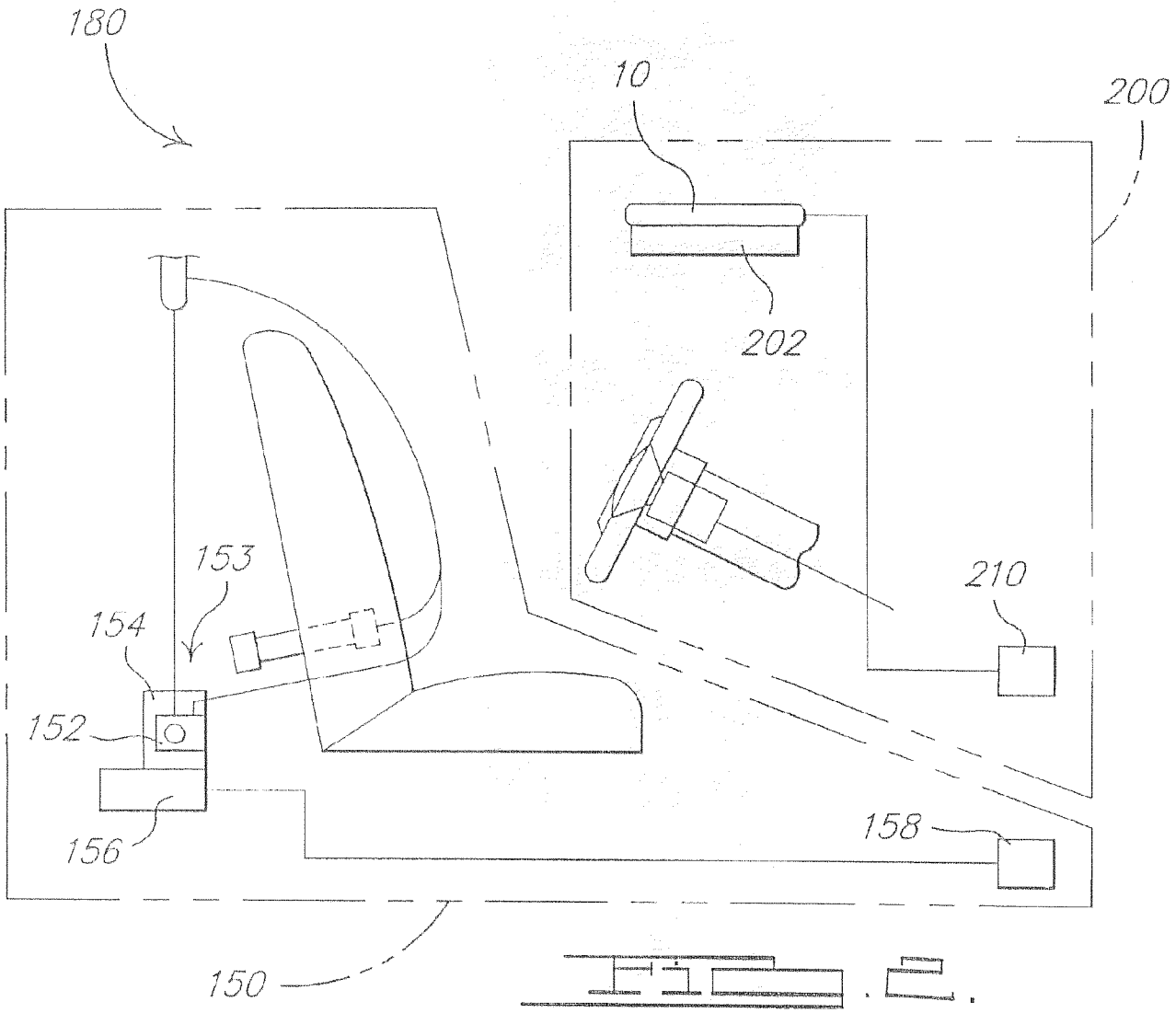
FIG. 2 is a schematic view of a gas generating system and a vehicle occupant restraint system incorporating the composition of the present invention.

As shown in FIG. 1, an inflator incorporating any of the compositions described above may be incorporated into a gas generating system 200, as exemplified in FIG. 2. Gas generating system 200 includes at least one airbag 202 and an airbag inflator 15 coupled to airbag 202 so as to enable fluid communication with an interior of the airbag for inflating the airbag in the event of a collision. Examples of inflators which may be incorporated into gas generating system 200 are described in U.S. Pat. Nos. 6,764,096, 6,659,500, 6,422,601, 6,752,421 and 5,806,888, each incorporated herein by reference. The inflator includes an embodiment of composition 17 as described above for use within the inflator. As shown within the inflator 10, the composition 17 thermodynamically communicates with an exterior of the inflator 17 and upon auto-ignition will fluidly communicate with the primary gas generant 19. It should be appreciated that the composition 17 as shown represents an extruded mixture subsequently cured within the inflator 10, or, in the alternative, a cured compressible composition 17 placed within the inflator 10 and compressed or impinged within the structure shown. Gas generating system 200 may also be in communication with a crash event sensor 210 including a known crash sensor algorithm that signals actuation of airbag system 200 via, for example, activation of airbag inflator 15 in the event of a collision.

Referring to FIG. 2, gas generating system 200 may also be incorporated into a broader, more comprehensive vehicle occupant restraint system 180 including additional elements such as a safety belt assembly 150. FIG. 2 illustrates a schematic diagram of one exemplary embodiment of such a restraint system.

Safety belt assembly 150 includes a safety belt housing 152 and a safety belt 100 in accordance with the present invention extending from housing 152. A safety belt retractor mechanism 154 (for example, a spring-loaded mechanism) may be coupled to an end portion 153 of the belt. In addition, a safety belt pretensioner 156 may be coupled to belt retractor mechanism 154 to actuate the retractor mechanism in the event of a collision. Typical seat belt retractor mechanisms which may be used in conjunction with the safety belt embodiments of the present invention are described in U.S. Pat. Nos. 5,743,480, 5,553,803, 5,667,161, 5,451,008, 4,558,832, and 4,597,546, incorporated herein by reference. Illustrative examples of typical pretensioners with which the safety belt embodiments of the present invention may be combined are described in U.S. Pat. Nos. 6,505,790 and 6,419,177, incorporated herein by reference.

Safety belt system 150 may be in communication with a crash event sensor 158 (for example, an inertia sensor or an accelerometer) including a known crash sensor algorithm that signals actuation of belt pretensioner 156 via, for example, activation of a pyrotechnic igniter (not shown) incorporated into the pretensioner. U.S. Pat. Nos. 6,505,790 and 6,419,177, previously incorporated herein by reference, provide illustrative examples of pretensioners actuated in such a manner. Again, composition 17 may also be employed within a micro gas generator formed in a known manner within pretensioner 156.

In yet another aspect of the invention, the compositions of the present invention may be integrated or deposited within or on the surface of a military armament or shell. This can be done by mixing the composition with a desired adhesive as described above, prior to curing of the adhesive. The adhesive or binder combined with the auto-ignition and booster constituents may then be extruded or deposited as desired along the surface or upon an inner wall of the respective device. Upon heat transfer through the shell or device, the composition will then readily ignite at the design auto-ignition temperature thereby activating the device prior to it reaching an explosive state, or prior to detonation. It should also be appreciated that the compositions of the present invention, absent or inclusive of the binder, may also be employed in accordance with the present invention in a pelletized or compressed molded form.

A preferred self-igniting composition of the present invention includes potassium perchlorate at about 42%, potassium chlorate at about 20%, d,l-tartaric acid at about 23%, and succinic acid at about 15%, said percents stated by weight of the composition without the binder added. Accordingly, alkali and alkaline earth metal perchlorates at about 35-50%, alkali and alkaline earth metal chlorates at about 15-30%, at least one carboxylic acid fuel, and preferably at least two carboxylic acids at about 25-45%, said percentages stated by weight of the composition, may be employed in accordance with the present invention. This formula has a hot plate ignition temperature of about 168 C, but can be modified to alter this temperature. Other ingredients may also be added or substituted to modify ignition characteristics including ignition temperature, heat output, flame temperature, and so forth. The compositions are dry or wet mixed by known methods. This formulation exhibits greater relative thermal and chemical stability over other self-igniting compositions such as sugar-potassium chlorate and related cellulose-based compositions.

In particular, adhesives/binders as described above may then be mixed in to aggregate the constituents and/or to apply the composition wherein the binder may be cured or uncured prior to application within the respective device.

It will be understood that the foregoing description of an embodiment of the present invention is for illustrative purposes only. As such, the features herein disclosed are susceptible to a number of modifications commensurate with the abilities of one of ordinary skill in the art, none of which departs from the scope of the present invention.

What is claimed is:

1. A composition consisting of:

a sugar selected from d-glucose, maltose, fructose, sucrose, and mixtures thereof;

a binder selected from the group consisting of chlorinated rubber, cellulose acetate butyrate, ceramics, high-melting waxes, and mixtures thereof;

potassium chlorate as a first oxidizer; and an optional second oxidizer selected from the group consisting of metal perchlorates, metal nitrites, metal oxides, basic metal nitrates, and mixtures thereof.

2. The composition of claim 1 wherein said second oxidizer is potassium perchlorate.

3. An autoignition composition consisting of:

DL-tartaric acid, succinic acid, potassium chlorate, and potassium perchlorate, wherein DL-tartaric acid, succinic acid, and potassium chlorate when combined are provided at about 35 weight percent, potassium perchlorate is provided at about 40 weight percent, and a binder selected from the group consisting of chlorinated rubber, cellulose acetate butyrate, ceramics, high-melting waxes, and mixtures thereof and is provided at about 25 weight percent of the total composition.

4. A composition consisting of:

an auto-ignition component consisting of a first fuel and a first oxidizer;

a secondary component consisting of a binder; wherein said first fuel is selected from the group consisting of sugars and mixtures thereof, said first fuel provided at about 15-45 weight percent of said auto-ignition component, said first oxidizer is selected from alkali and alkaline earth metal chlorates, said first oxidizer provided at about 55-85 weight percent of said auto-ignition component; and a secondary oxidizer provided at about 0.1-50 weight percent of the total composition, said second oxidizer selected from the group consisting of metal perchlorates, metal nitrates, metal nitrites, metal oxides, basic metal nitrates, and mixtures thereof, wherein said binder is selected from the group consisting of silicone, chlorinated rubber, cellulose acetate butyrate, ceramics, high-melting waxes, and mixtures thereof and is provided at about 10-50 weight percent of the total composition.

5. A composition consisting of:

an auto-ignition component consisting of a first fuel and a first oxidizer;

a secondary component consisting of a binder; wherein said first fuel is selected from the group consisting of sugars and mixtures thereof, said first fuel provided at about 15-45 weight percent of said auto-ignition component, said first oxidizer is selected from alkali and alkaline earth metal chlorates, said first oxidizer provided at about 55-85 weight percent of said auto-ignition component; and said binder is selected from the group consisting of silicone, chlorinated rubber, cellulose acetate butyrate, ceramics, high-melting waxes, and mixtures thereof and is provided at about 10-50 weight percent of the total composition.

6. The composition of claim 5 wherein said sugars are selected from the group consisting of d-glucose, maltose, fructose, sucrose, and mixtures thereof.

7. A gas generating system containing the composition of claim 5.

8. A vehicle occupant protection system containing the composition 5.

* * * * *

UNITED STATES PATENT AND TRADEMARK OFFICE

CERTIFICATE OF CORRECTION

PATENT NO. : 9,162,933 B1
APPLICATION NO. : 12/658279
DATED : October 20, 2015
INVENTOR(S) : Hordos et al.

It is certified that error appears in the above-identified patent and that said Letters Patent is hereby corrected as shown below:

In the Specification:

| | |
|---|---|
| Column 5; Line 59; | Please delete “calorimetry” and insert --Calorimetry--. |
| Column 6; Line 12; | Please delete “calorimetry” and insert --Calorimetry--. |
| Column 6; Line 34; | Please delete “calorimetry” and insert --Calorimetry--. |
| Column 6; Line 56; | Please delete “calorimetry” and insert --Calorimetry--. |
| Column 7; Line 10; | Please delete “calorimetry” and insert --Calorimetry--. |
| Column 7; Line 19; | Please delete “d,1-tartaric” and insert --d,l-tartaric--. |
| Column 7; Line 35; | Please delete “Uftem” and insert --Ultem-- |
| Column 11; Line 19; | Please delete “d,1-tartaric” and insert --d,l-tartaric--. |

Signed and Sealed this
Eighth Day of December, 2015

Michelle K. Lee

Michelle K. Lee
*Director of the United States Patent and Trademark Office*